US007624687B2

(12) United States Patent
Vithani et al.

(10) Patent No.: US 7,624,687 B2
(45) Date of Patent: Dec. 1, 2009

(54) TRUCK APPARATUS FOR RAILWAY CARS

(75) Inventors: Anand R. Vithani, Addison, IL (US); David C. Brabb, Chicago, IL (US); Anand Prabhakaran, Clarendon Hills, IL (US); Som P. Singh, Naperville, IL (US)

(73) Assignee: Sharma & Associates, Inc., Countryside, IL (US)

( * ) Notice: Subject to any disclaimer, the term of this patent is extended or adjusted under 35 U.S.C. 154(b) by 284 days.

(21) Appl. No.: 11/588,052

(22) Filed: Oct. 26, 2006

(65) Prior Publication Data

US 2008/0098925 A1 May 1, 2008

(51) Int. Cl.
*B61D 1/00* (2006.01)

(52) U.S. Cl. ..... 105/157.1; 105/165

(58) Field of Classification Search ..... 105/157.1, 105/182.1, 185, 453
See application file for complete search history.

(56) References Cited

U.S. PATENT DOCUMENTS 4,526,107 A * 7/1985 Mautner et al. ..... 105/133
4,841,875 A * 6/1989 Corsten et al. ..... 105/224.05
5,024,165 A * 6/1991 Panagin ..... 105/168

* cited by examiner

*Primary Examiner*—S. Joseph Morano
*Assistant Examiner*—Robert J McCarry, Jr.
(74) *Attorney, Agent, or Firm*—James Ray & Assoc.

(57) ABSTRACT

A truck apparatus for a railway car includes a pair of wheel sets each having a pair of wheels joined by an axle. A frame is provided for carrying one end of a railway car body and a system positions the frame in a pendulum fashion from each axle end in order to independently decouple, from each other, vertical, lateral and longitudinal forces applied to the frame by the wheel sets during operation of the railway car.

18 Claims, 2 Drawing Sheets

TRUCK APPARATUS FOR RAILWAY CARS

FIELD OF THE INVENTION

The present invention relates, in general, to railway trucks and, more particularly, this invention relates to a railway truck having improved directional stability.

BACKGROUND OF THE INVENTION

As is generally well known, trucks for railway cars and, more particularly, freight railway cars are available in two design types. The first design type employs an H-frame that combines bolster and side frames into one component. This H-frame is connected to the wheel-set axles by way of helical coil springs, friction/viscous dampers and pedestals. This arrangement is widely known in the railroad industry as a primary suspension truck.

Another design type employs a 3-piece construction, wherein the bolster is oriented laterally between two longitudinally disposed side frames. The side frames in turn are connected to two wheel-set axles by way of bearing adapters and bearings. Main suspension elements include helical coil springs and friction wedge dampers, which connect the bolster and the side frames. This arrangement is widely known in the railroad industry as a secondary suspension of the truck.

Either truck design type is mounted for movement in vertical, lateral and longitudinal directions in order to accommodate various operational conditions.

The disadvantage of either the primary suspension truck or the secondary suspension truck is that when the truck is forced to move in any one direction, the coil spring groups, due to an inherent stiffness, also generate forces in the remaining two directions. Accordingly, prior to the present invention, some trucks enable operation of the railway car up to speed of 110 mph. Above this speed, the trucks become directionally and, more particularly, laterally unstable resulting in increased wear of the wheels, rails and truck components and potentially causing unsafe operations, including derailment. Such lateral instability is commonly known as hunting oscillation.

Lately, there is a growing need for a high-speed freight transport in the railroad industry wherein the railway cars would need to travel at speeds greater than 110 mph. Therefore, there is a need for an improved truck that allows high-speed operation of the railway car at speeds greater than 110 mph and without lateral instability of the presently available trucks.

SUMMARY OF THE INVENTION

The invention provides a truck apparatus for a railway car. The truck apparatus includes a pair of wheel sets each having a pair of wheels joined by an axle. A frame is provided for carrying one end of a railway car body. There is a system for positioning the frame from each axle end in order to decouple from each other vertical, lateral and longitudinal forces which are applied by the wheel sets to the frame during operation of the railway car.

OBJECTS OF THE INVENTION

It is, therefore, one of the primary objects of the present invention to provide an improved truck apparatus for a railway car.

Another object of the present invention is to provide an improved truck apparatus for a railway car which is directionally stable at speeds higher than 110 mph.

Yet another object of the present invention is to provide an improved truck apparatus for a railway car which decouples vertical, lateral and longitudinal forces which are applied to the truck frame by the wheel sets.

A further object of the present invention is to provide an improved truck apparatus for a railway car which employs a suspended frame.

An additional object of the present invention is to provide an improved truck apparatus for a railway car which employs spring means and pivot members for decoupling vertical, lateral and longitudinal forces between the wheel sets and truck frame. Another object of the present invention is to provide an improved truck apparatus for a railway car which enables travel of the railway car at speeds greater than 110 mph and which fits within the space envelope mandated by the industry standards for ease of interchangeability.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
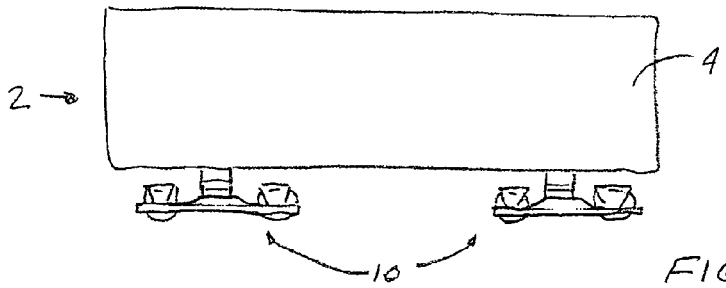
FIG. 1 is a side elevation view of a railway car provided with a truck apparatus of the present invention.

Prior to proceeding to the more detailed description of the present invention, it should be noted that, for the sake of clarity and understanding, identical components which have identical functions have been identified with identical reference numerals throughout the several views illustrated in the drawing figures.

The present invention overcomes the disadvantage of the prior art trucks for a railway car by providing an improved truck apparatus incorporating a frame which is suspended below wheel axles in a pendulum like arrangement.

Reference is now made, to FIGS. 1-5, wherein there is shown a truck apparatus, generally designated as 10, for supporting one end of a railway car body 4. As is well known in the art, a pair of truck apparatuses 10 in combination with the car body 4 and other components (not shown) form a railway car, generally designated as 2. The truck 10 includes a pair of conventional wheel sets 12 each having a pair of wheels 14 joined by an axle 16. Each end of each axle 16 includes a bearing housing 18 secured thereto as is well known in the art. A frame means, generally designated as 20, is provided for carrying one end of the railway car body 4. A plurality of suspension means, generally designated as 40, each positioned at a respective axle end, are provided for positioning predetermined portions of the frame means 20 relative to the pair of wheel sets 12 and, more particularly, below the axles 16, for decoupling, from each other, vertical, lateral and longitudinal forces applied to the frame means 20 by the wheel sets 12.

The frame means 20 of the present invention includes a first member 22 which is aligned laterally relative to the railway car body 4. The first member 22 functions as a conventional bolster member including a conventional center bowl 24 for receiving a center plate (not shown) of the railway car body 2 and a pair of apertures 26 for receiving force transmitting linkage of the brake rigging (not shown). A pair of side members 30 are positioned at opposite ends respectively of the first member 22 and are aligned longitudinally relative to the railway car body 4. It is presently preferred for such frame means 20 to be manufactured as a unitary construction either by welding or casting method. By way of example, in FIG. 1, the frame means 20 is illustrated as being formed by a plurality of tubular members joined therebetween into a unitary construction by a welding method. The materials, thicknesses and cross-sectional shape and sizes of such tubular members are predetermined based on the service conditions and further defined by the weight of the railway car body 2.

In the presently preferred embodiment of the invention, the suspension means 40 includes a pedestal housing 42 which has a predetermined shape. To accommodate mounting of various components whose structure and function will be described below and to operatively engage the axle end, the pedestal housing 42 is formed as a generally U-shaped member 42 having a horizontally disposed portion 44 and a pair of trapezoidally shaped side portions 46 which are vertically positioned and which extend from the portion 44. A bearing adapter 48 is rigidly attached to the pedestal housing 42, and more particularly, to free ends of such pair of portions 46, for operatively engaging the bearing housing 18 mounted on the axle end.

To provide for directional stability of the truck apparatus 10, the suspension means 40 includes a triad of means each engageable with the housing member 42 and the frame 20 for decoupling, from each other, forces applied to the frame means 20 in vertical, lateral and longitudinal directions by the wheel sets 12.

Figure 3:
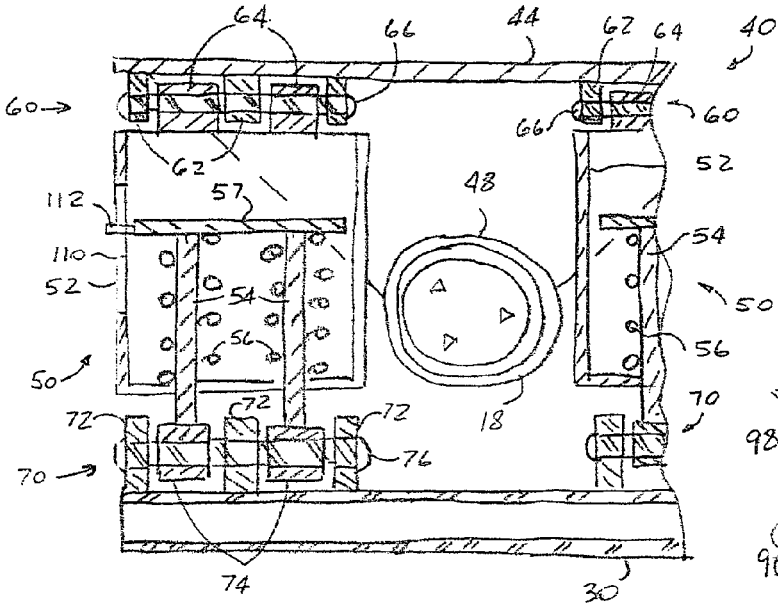
FIG. 3 is a partial cross-sectional view of the truck apparatus of FIG. 2.
Figure 5:
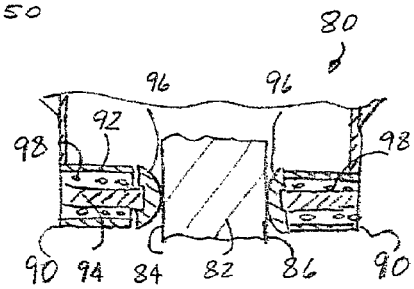
FIG. 5 is a partial cross-sectional view of the truck apparatus of FIG. 2.
Figure 2:
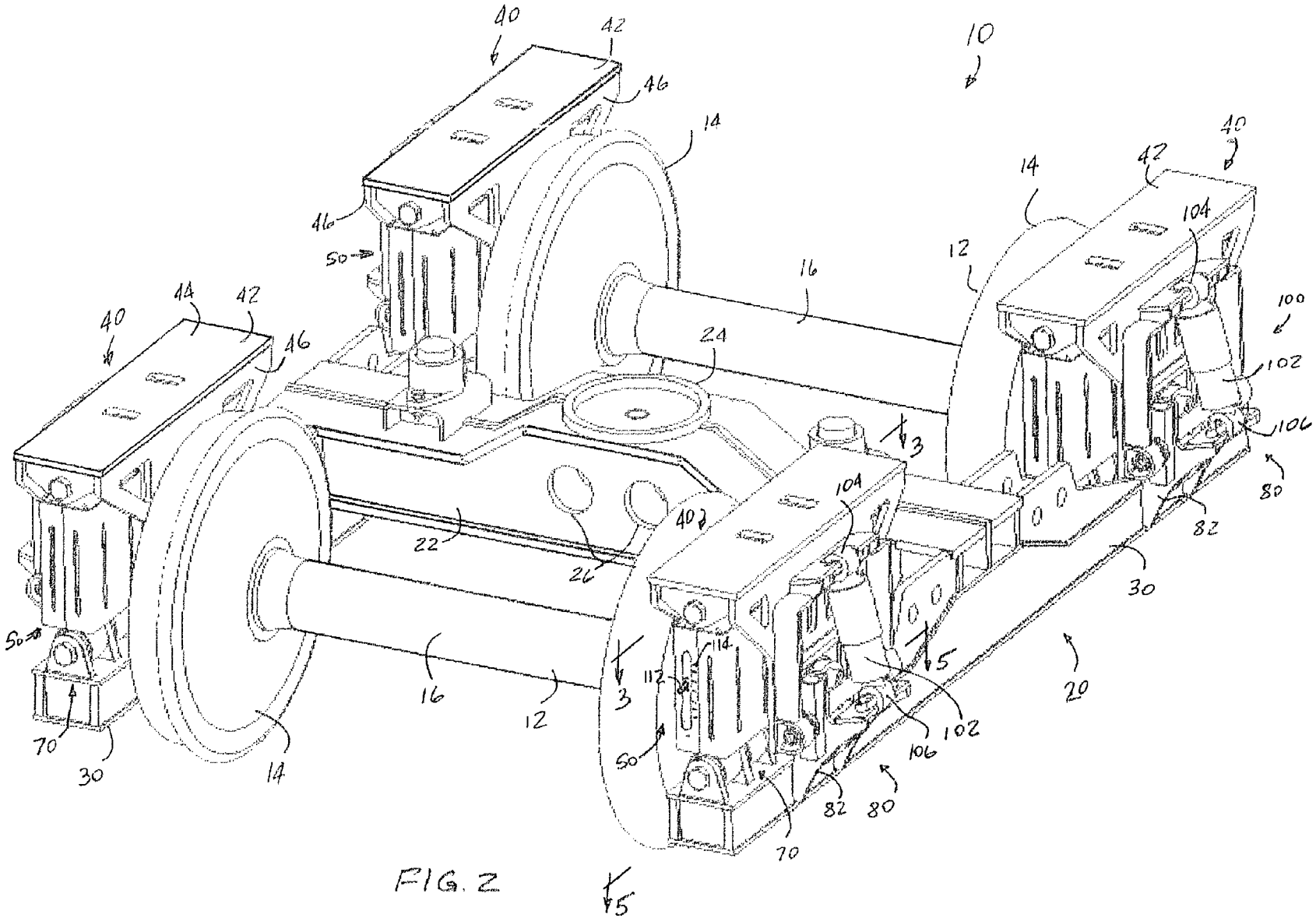
FIG. 2 is a perspective view of the truck apparatus constructed according to a presently preferred embodiment of the invention.

A vertical force decoupling means includes a pair of assemblies, generally designated as 50 and best shown in FIGS. 2-3, which are oppositely positioned relative to a longitudinal axis of the axle 16. Each assembly 50 has a generally hollow housing 52 which is adapted for receiving at least one elongated rod member 54. Such rod member 54 is vertically positioned within the hollow housing 52 and is mounted for a linear movement therewithin. A resilient means 56 is provided for biasing the at least one elongated rod member 54 for movement in an upward direction. Preferably, the present invention employs a pair of juxtaposed and spaced rod member 54 and a pair of resilient means 56. The resilient means 56 is a spring means 56 and, preferably, a compression spring means 56.

Figure 4:
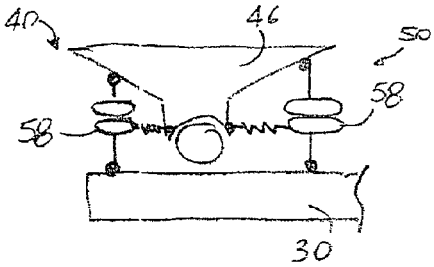
FIG. 4 is a partial schematic representation of the truck apparatus of FIG. 2, particularly illustrating suspension means constructed according to one alternative embodiment of the invention.

Now in a particular reference to FIG. 4, it has been found that employment of resilient spring means, such as air spring means 58 which is pivotally attached to both the pedestal housing 42 and the frame means 20, also improves operation performance and directional stability of the truck apparatus 10. Such resilient spring means may be also a conventional tension spring means (not shown).

The lateral force decoupling means includes a first pivot means, generally designated as 60, for pivotally attaching upper end of the hollow housing 52 to the pedestal housing 42 and a second pivot means, generally designated as 70, for pivotally attaching a lower end of the at least one elongated rod member 52 to the frame means 20. By way of example of FIG. 3, the first pivot means 60 is shown as including at least a pair of members 62 which are attached to the pedestal housing 42 and at least one member 64 which is attached to the upper end of the housing 52 being operatively interposed with each other and joined by a shaft member 66 for enabling the pivotal movement.

Like wise, the second pivot means 70 includes at least a pair of members 72 which are attached to the side member 30 of the frame means 20 and at least one member 74 which is attached to the lower end of the rod member 54 being operatively interposed with each other and joined by a shaft member 76 for enabling the pivotal movement.

It will be apparent to those skilled in the art that any other pivot means 60 and 70, for example of a well known ball joint arrangement (not shown), may be employed in the present invention.

The longitudinal force decoupling means, generally designated as 80, includes a bracket means 82 which is rigidly attached to the side member 30 of the frame means 20 and which has a pair of vertically disposed surfaces 84 and 86. The means 80 further includes a pair of resilient assemblies 90 attached to the housing 52. Each resilient assembly 90 includes an aperture 92 which is formed in the pedestal housing 42 and which has axis thereof disposed in a longitudinal direction relative to such railway truck body 2. A shaft member 94 is mounted for a linear movement within each aperture 92 and has a mushroom head 96 engaging the respective surface 84, 86 of the bracket means 82. A spring means 98 is caged within each aperture 92 for biasing the mushroom head 96 for engagement with such respective surface 84, 86 of the bracket means 82 and, more particularly, for biasing the bracket means 82 in opposed longitudinal directions. Advantageously, employment of the mushroom head 96 enables the vertical movement of the bracket means 82 and the frame means 20 attached thereto.

The apparatus may include an optional damper means, generally designated as 100, for absorbing energy generated by the frame means 20 during at least one of the vertical and lateral movement thereof. Now in further reference to FIG. 1, such damper means 100 includes a hydraulic cylinder 102, a first pivot means 104 for pivotally attaching one end of the cylinder 102 to the pedestal housing 42 and a second pivot means 106 for pivotally mounting an opposed end of the cylinder 102 to the frame means 20 and preferably to the bracket means 82. Preferably, a longitudinal axis of the hydraulic cylinder 102 is disposed at a predetermined angle for absorbing energy generated by the frame means 20 during both vertical and lateral movements thereof.

The construction of the suspension means 40 and, more particularly the construction of the vertical force decoupling means 50, is advantageous for incorporating means for sensing a condition of the load carried by such car body 4 by way of determining vertical travel of the frame means 20 and correlating such vertical travel to various load conditions. In further references to FIGS. 2-3, such sensing means includes a member 57 which is attached to upper end of the elongated rod member 54. An indicator portion 112 is attached to such member 57 and protrudes beyond the wall of the housing member 52 through the vertically oriented slot 110 formed therein. A plurality of markings 114 are provided on the exterior surface of the housing member 52 in aligned relationship with the slot 110 for visually determining the load condition carried by the car body 4. It would be apparent to those skilled in the art that the uppermost marking will be representative of the empty load condition and that the lowermost marking will be representative of the full load condition. Switches (not shown) and/or valves (not shown) presently used in systems for sensing load conditions may be further employed in the present invention. It will be further apparent to those skilled in the art that such load sensing means may be provided at least one additional axle end.

It will be apparent to those skilled in the relevant art form that for improved operation of the railway car 2 it is essential to maintain each truck apparatus 10 of such railway car 2 as close to its equilibrium as possible. In this condition, all forces acting on to the truck apparatus 10 cancel each other so that a static or dynamically balanced situation results. Because, the prior art trucks utilize simple compression springs rigidly attached at each end, vertical forces resulting from vertical oscillations of the truck cause lateral and longitudinal oscillations further explained by a coupling effect of all directional forces within such compression spring. Like wise, lateral forces resulting from lateral oscillations of the wheel sets 12 cause vertical and longitudinal oscillations.

The truck apparatus 10 of the present invention essentially decouples each directional force from the other two and further provides dampening arrangement for each directional force.

In operation, movement of the wheel sets 12 follows perturbations and irregularities which are present in conventional rail tracks. This, in turn, results in undesirable movements of the wheel sets 12 relative to the frame means 20. Forces which are generated by the wheel sets 12 in the lateral and longitudinal direction and which are applied to the frame means 20 and subsequently are transferred to the car body 4 create a dynamically unstable operation of the railway car 2. The present invention allows for effective decoupling between the wheel sets 12 and the frame means 20 in the lateral and longitudinal direction and, more particularly, decoupling the forces applied to the frame means 20 and the car body 4 and, thus improving the dynamic stability of the railway car 2 during operation at speeds greater than 110 mph.

When the wheel sets 12 oscillate in a vertical direction, such oscillation causes like movements of the housing members 52. The spring means 56 compensates for a vertical movement of the housing member 52 and the damper means 100 absorbs the energy generated due to the vertical movement. Employment, of the first pivot means 60 and the second pivot means 70 decouples forces generated by the wheel sets 12 in the lateral direction from the forces generated in the vertical direction. Employment of the resilient assemblies 90 further decouples forces generated by the wheel sets 12 in the longitudinal direction from the forces generated in each of the vertical and longitudinal direction. Advantageously, employment of a pair of oppositely operative resilient assemblies 90 limits longitudinal movement of the wheel sets 12.

It would be further apparent to those skilled in the art that suspending the frame means 20 under the axles 16 provides for a pendulum like arrangement of the tuck apparatus 10 enabling the gravitational forces on the frame means 20 to easily compensate for any lateral and/or longitudinal disturbances of the truck apparatus 10.

Dynamic simulations of the truck apparatus 10 of the present invention achieved excellent performance results at speeds greater than 150 mph while providing for directional stability of the truck apparatus 10 and dynamic stability of the railway car 2 during operation.

Furthermore, the construction of the frame means 20 and the suspension means 40 meets various space envelop requirements mandated by the industry standards.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A truck apparatus for a railway car, said truck apparatus comprising:

(a) a pair of wheel sets each having a pair of wheels joined by an axle;

(b) a frame means for carrying one end of a railway car body, said frame means including a first member aligned laterally relative to said railway car body and a pair of side members positioned at opposite ends respectively of said first member external to a respective pair of wheels and aligned longitudinally relative to such railway car body; and (c) a plurality of suspension means each positioned at a respective axle end for positioning said side members of said frame means in a suspended pendulum manner relative to said pair of wheel sets below respective axles thereof and for decoupling from each other vertical, lateral and longitudinal forces applied to said frame means relative by said pair of wheel sets.

2. The apparatus according to claim 1, wherein said suspension means includes:

(a) a pedestal housing having a predetermined shape;

(b) a bearing adapter rigidly attached to said pedestal housing and operatively engaging a bearing housing mounted on said respective axle end;

(c) means engageable with said pedestal housing and with said frame means for decoupling vertical forces;

(d) means engageable with said pedestal housing and with said frame means for decoupling lateral forces from said vertical forces; and (e) means engageable with said pedestal housing and with said frame means for decoupling longitudinal forces from each of said lateral and said vertical forces.

3. The apparatus according to claim 2, wherein said predetermined shape of said pedestal housing includes a generally U-shaped member having a pair of trapezoidally shaped and vertically positioned side portions.

4. The apparatus according to claim 2, wherein said vertical force decoupling means includes a pair of devices which are oppositely positioned relative to a longitudinal axis of said axle and which are aligned in a longitudinal direction relative to said railway car body, each device including:

(a) a generally hollow housing;

(b) at least one elongated rod member which is vertically positioned within said hollow housing and which is mounted for a linear movement therewithin; and (c) a spring means for biasing said at least one elongated rod member in an upward direction.

5. The apparatus according to claim 4, wherein said lateral force decoupling means includes:

(a) a first pivot means for pivotally attaching upper end of said hollow housing to said pedestal housing; and (b) a second pivot means for pivotally attaching a lower end of said at least one elongated rod to said frame means.

6. The apparatus according to claim 4, wherein said apparatus further includes means for sensing a load condition of such railway car.

7. The apparatus according to claim 6, wherein said load sensing means includes:

(a) an elongated slot vertically formed in a wall of said hollow housing;

(b) an indicator member which is attached to upper end of said at least one elongated member and which protrudes through said elongated slot beyond an exterior surface of said hollow housing; and (c) a plurality of markings vertically formed on said exterior surface of said hollow housing and aligned with said elongated slot, whereby an uppermost marking represents an empty load condition and whereby a lowermost marking represents a full load condition.

8. The apparatus according to claim 2, wherein said longitudinal force decoupling means includes:

(a) a bracket rigidly attached to said frame means and having a pair of vertically disposed surfaces; and (b) a pair of resilient assemblies attached to said pedestal housing each engaging a respective one of said pair of surfaces for biasing said bracket in opposed longitudinal directions, said pair of resilient assemblies enabling said vertical movement of said frame means and said bracket attached thereto.

9. The apparatus according to claim 8, wherein each of said pair of said resilient assemblies includes:

(a) an aperture which is formed in said pedestal housing and which is longitudinally disposed;

(b) a shaft member mounted for a linear movement within said housing, said shaft member having a mushroom head engaging said bracket; and (c) a spring means caged within said aperture for biasing said mushroom head for engagement with said respective one of said pair of surfaces.

10. The apparatus according to claim 1, wherein said apparatus further includes a damper means for absorbing energy generated by said frame means during at least one of said vertical and said lateral movement thereof.

11. The apparatus according to claim 10, wherein said damper means includes a hydraulic cylinder, a first pivot means for pivotally attaching one end of said cylinder to said pedestal housing and a second pivot means for pivotally attaching an opposed end of said cylinder to a predetermined portion of said frame means.

12. The apparatus according to claim 11, wherein a longitudinal axis of said hydraulic cylinder is disposed at a predetermined angle for absorbing energy generated by said frame means during said vertical and said lateral movement thereof.

13. In a railway car having a car body, a pair of frames each supporting one end of such car body and having a pair of side members disposed longitudinally relative to such car body and two pairs of wheel sets each pair is associated with a respective one of such pair of frames, an improvement comprising a means for positioning said longitudinally disposed side members of each frame in a suspended pendulum manner from opposed ends of each wheel set below respective axles thereof and external to each wheel and for decoupling from each other vertical, lateral and longitudinal forces applied to said frame by said pair of wheel sets.

14. A truck apparatus for a railway car, said truck apparatus comprising:

(a) a pair of wheel sets each having a pair of wheels joined by an axle;

(b) a frame means for carrying one end of a railway car body; and (c) a plurality of suspension means each positioned at a respective axle end for positioning said frame means relative to said pair of wheel sets and for decoupling from each other vertical, lateral and longitudinal forces applied to said frame means by said pair of wheel sets, said each suspension means including:

(i) a pedestal housing having a predetermined shape, (ii) a bearing adapter rigidly attached to said pedestal housing and operatively engaging a bearing housing mounted on said respective axle end, (iii) means engageable with each of said pedestal housing and said frame means for decoupling vertical forces, (iv) means engageable with said each of said pedestal housing and said frame means for decoupling lateral forces from said vertical forces, (v) a bracket rigidly attached to said frame means and having a pair of vertically disposed surfaces, and (vi) a pair of resilient assemblies attached to said pedestal housing each engaging a respective one of said pair of surfaces for biasing said bracket in opposed longitudinal directions, said pair of resilient means enabling said vertical movement of said frame means and said bracket attached thereto.

15. A truck apparatus for a railway car, said truck apparatus comprising:

(a) a pair of wheel sets each having a pair of wheels joined by an axle;

(b) a frame means for carrying one end of a railway car body; and (c) a quartet of suspension means, each of said quartet of suspension means positioned at a respective axle end external to a respective wheel and connected to a predetermined portion of said frame means for decoupling from each other vertical, lateral and longitudinal forces applied to said frame means by said pair of wheel sets, said each suspension means including:

(i) a pedestal housing having a predetermined shape, (ii) a bearing adapter rigidly attached to said pedestal housing and operatively engaging a bearing housing mounted on said respective axle end, (iii) a generally hollow housing mounted within said pedestal, at least one elongated rod member which is vertically positioned within said hollow housing and which is mounted for a linear movement therewithin, (iv) a spring means for biasing said at least one elongated rod member in an upward direction for decoupling said vertical forces, (v) means engageable with said pedestal housing and with said frame means for decoupling said lateral forces from said vertical forces, and (vi) means engageable with said pedestal housing and with said frame means for decoupling said longitudinal forces from each of said lateral and said vertical force.

16. The apparatus according to claim 15, wherein said lateral force decoupling means includes:

(a) a first pivot means for pivotally attaching upper end of said hollow housing to said pedestal housing; and (b) a second pivot means for pivotally attaching a lower end of said at least one elongated rod to said frame means.

17. The apparatus according to claim 15, wherein said apparatus further includes means for sensing a load condition of such railway car.

18. The apparatus according to claim 17, wherein said load sensing means includes:

(a) an elongated slot vertically formed in a wall of said hollow housing;

(b) an indicator member which is attached to upper end of said at least one elongated member and which protrudes through said elongated slot beyond an exterior surface of said hollow housing; and (c) a plurality of markings vertically formed on said exterior surface of said hollow housing and aligned with said elongated slot, whereby an uppermost marking represents an empty load condition and whereby a lowermost marking represents a full load condition.

* * * * *